US009840387B2

(12) United States Patent
Shigihara et al.

(10) Patent No.: US 9,840,387 B2
(45) Date of Patent: Dec. 12, 2017

(54) BELT CONVEYANCE APPARATUS AND IMAGE FORMING APPARATUS

(71) Applicant: CANON KABUSHIKI KAISHA, Tokyo (JP)

(72) Inventors: Keita Shigihara, Toride (JP); Hideaki Kosasa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/678,151

(22) Filed: Apr. 3, 2015

(65) Prior Publication Data

US 2015/0284197 A1 Oct. 8, 2015

(30) Foreign Application Priority Data

Apr. 7, 2014 (JP) ..... 2014-078794

(51) Int. Cl.

*B65H 5/02* (2006.01)
*G03G 15/00* (2006.01)
*G03G 15/16* (2006.01)

(52) U.S. Cl.

CPC ..... *B65H 5/025* (2013.01); *G03G 15/6529* (2013.01); *B65H 2301/531* (2013.01); *B65H 2404/143* (2013.01); *B65H 2404/224* (2013.01); *B65H 2404/25* (2013.01); *B65H 2801/06* (2013.01); *G03G 15/1605* (2013.01); *G03G 15/1685* (2013.01); *G03G 2215/00151* (2013.01); *G03G 2215/00679* (2013.01); *G03G 2215/1623* (2013.01)

(58) Field of Classification Search

CPC ..... B65H 2404/224; B65H 2301/531; B65H 2404/243

See application file for complete search history.

(56) References Cited

U.S. PATENT DOCUMENTS 5,526,028 A * 6/1996 Rottman ..... B41J 11/007 347/102
7,764,918 B2 * 7/2010 Kawagoe ..... G03G 15/161 399/350
8,433,225 B2 * 4/2013 Michibata ..... G03G 15/161 399/302

FOREIGN PATENT DOCUMENTS

JP 2002132057 A 5/2002
JP 2004149241 A 5/2004
JP 2005070496 A 3/2005
JP 2009042723 A 2/2009
JP 2009075224 A 4/2009

* cited by examiner

*Primary Examiner* — Howard Sanders
(74) *Attorney, Agent, or Firm* — Canon U.S.A., Inc. IP Division

(57) ABSTRACT

A belt conveyance apparatus includes a plurality of support rollers, an endless belt, a regulation portion configured to regulate a shift of the endless belt in a width direction, a regulation receiving member configured to contact the regulation portion to receive a regulation force by the regulation portion, and support members disposed on an upstream side, in a conveyance direction of the endless belt, of the support rollers provided with the regulation portion to oppose each other on an inner peripheral surface side and an outer peripheral surface side of the end portion side of the endless belt in the width direction, and configured to regulate a position of the regulation receiving member when the regulation receiving member enters a contact portion with the regulation portion.

15 Claims, 14 Drawing Sheets

BELT CONVEYANCE APPARATUS AND IMAGE FORMING APPARATUS

BACKGROUND OF THE INVENTION

Field of the Invention

The present invention relates to a belt conveyance apparatus employed in an image forming apparatus of an electrophotographic method or of an electrostatic recording method, and an image forming apparatus including the belt conveyance apparatus.

Description of the Related Art

Conventionally, in an image forming apparatus employing an electrophotographic method and the like, an intermediate transfer member and an endless belt (hereinbelow, sometimes simply referred to as an belt) are employed. Onto the intermediate transfer member, a toner image to be transferred to a recording medium is temporarily transferred. The belt is used as a recording medium bearing member to convey a recording medium on which a toner image is transferred. Further, a belt may be used, for example, as a recording medium conveyance member for conveying a recording medium that contacts the intermediate transfer member at a transfer portion where a toner image is transferred from the intermediate transfer member to the recording medium.

A belt conveyance apparatus that conveys such a belt includes a belt and a plurality of support rollers around which the belt is wound. In the belt conveyance apparatus, a belt shift may occur due to the alignment deviation and the conveyance friction of the support rollers. In the belt shift, the belt is moved in a width direction, which is a direction substantially orthogonal to the belt conveyance direction (i.e., thrust direction).

Therefore, conventionally, in order to restrain the belt shift, a belt shift regulation means has been used. Examples of the belt shift regulation means include the following configurations. Specifically, at the end portions of inner peripheral surface side (i.e., back side) of the belt in a width direction, regulation ribs as receiving members are provided, regulation rollers (i.e., flanges) as regulation portions are provided at respective end portions of at least one support roller in a rotation axis direction. Then, the regulation ribs are brought into contact with the regulation roller to regulate the movement of the belt in the width direction.

In addition, there is discussed a technique for regulating bending of the belt generated due to the contact of the regulation rib with the regulation roller, and improving the effect of the belt shift regulation.

For example, Japanese Patent Application Laid-open No. 2002-132057 discusses a technique in which a biasing member for biasing the belt is provided at an opposing position of the regulation roller on an outer peripheral surface side (i.e., front surface) of the belt, in the belt shift regulation means including a regulation rib and a regulation roller.

In addition, Japanese Patent Application Laid-open No. 2009-42723 discusses following configurations. Specifically, in the belt shift regulation means in which an end portion of the belt as a regulation receiving member in a width direction is brought into contact with a contact portion as a regulation portion, a biasing member for biasing the belt in a thickness direction on a front surface side of the belt near the contact position and upstream side of the belt conveyance direction.

Further, Japanese Patent Application Laid-open No. 2005-070496 discusses a configuration in which a back up member is provided to support a belt from the back side of the belt.

Meanwhile, the belt conveyance apparatus including a belt with a relatively shorter peripheral length and a support roller with a small diameter is susceptible to the attitude change of the regulation rib. Therefore, as illustrated in FIG. 12, riding-on of a belt 201 may easily occur due to the rising of a regulation rib 202 over a regulation roller 203 when the belt 201 is moved to one side in a width direction of the belt 201. The reason will be described below.

In the example illustrated in FIG. 12, the regulation rib 202 is provided on the entire circumference of the belt 201 at both end portions of a back side thereof in a width direction, and a regulation roller (flange) 203 is provided on each end portion of a support roller 204 in a rotation axis direction. The regulation roller 203 includes an oblique surface (taper portion) at the end portion thereof. The oblique surface inclines to increase the diameter thereof as going up toward the center side of the rotation axis direction of the support roller 204. In addition, FIG. 12 is a cross sectional view illustrating vicinity of the support roller 204 and on the upstream side of the belt 201 in the conveyance direction.

For example, when the inner side of the belt conveyance apparatus becomes dirty due to scattering of developer or the like, it may cause a quality deterioration of an image or increase a shift amount of a belt. Therefore, to prevent entering of the developer and the like inside the belt conveyance apparatus, a scattering prevention member such as a fur brush may be provided at each end portion of back side of the belt in a width direction. The scattering prevention member may sometimes be provided to enter a stretching surface of the belt from the inside toward the outside of the belt. In this case, as illustrated in FIG. 13, the end portion of the belt 201 in the width direction is deformed by the scattering prevention member 205 to be expanded from the inside toward the outside, and it may cause the attitude of the regulation rib 202 to be unstable when the regulation rib 202 enters a regulation operation portion, which is the contact portion with the regulation roller 203. Further, when, on the upstream side of the support roller in which the regulation roller is provided in the conveyance direction of the belt, a support roller with an inverse crown shape (i.e., the external diameter at the center portion thereof is smaller than those at the end portions thereof in the rotation axis direction) is provided or a fur roller for cleaning the belt is provided, a similar disadvantage may occur. In addition, in a case of a belt with a relatively short peripheral length, the attitude of the regulation rib 202 is not easily corrected while the belt enters the contact portion with the regulation roller from the expanded position from the inside to the outside, as described above. As a result, the shift regulation of the belt may easily become unstable.

Further, as illustrated in FIG. 14, when the end portion of the belt 201 in the width direction is deformed to be pressed from the outside toward the inside, the attitude of the regulation rib 202 may become unstable when the belt 201 enters the regulation operation portion, which is the contact portion with the regulation roller 203 having a taper. This may occur in a case where a support roller in a normal crown shape (i.e., the external diameter at the center portion is larger than those at the end portions thereof in the rotation axis direction) is provided on the upstream side of the support roller in which the regulation roller is provided in the conveyance direction of the belt. Also in this case, since the attitude of the regulation rib may be changed, similarly as described above, in a case of a belt with a relatively short peripheral length, the belt shift regulation may become easily unstable.

Meanwhile, in order to make the belt shift regulation more secure, a solution to increase the thickness of the regulation rib may be conceivable. However, in the belt conveyance apparatus provided with a relatively short peripheral length and a support roller with a relatively small diameter, as the curvature of the belt is small, it is disadvantageous in terms of durability. Therefore, it may not be an effective solution.

There is a method for improving the belt shift regulation ability by biasing the end portion of the belt in the width direction from one side of the belt (i.e., the front surface side or the back surface side), as the above-described conventional technique.

However, for example, when a biasing member is disposed to press the position opposing the regulation roller, friction between the regulation roller and the regulation rib may become excessively large. As a result, a force may act in a direction to raise the regulation rib over the regulation roller, and the contact position of the regulation rib and the regulation roller moves near the outer periphery side of the regulation roller. As a result, riding-on may occur. Further, for example, in a case where the biasing member is disposed near the belt shift regulation operation portion and on the front surface side of the belt on the upstream side in the conveyance direction, the end portion of the belt in the conveyance direction may be pressed more than necessary from the outside toward the inside. Also in this case, similarly as described above, sufficient belt shift regulation cannot be achieved, and riding-on may occur.

In addition, the above-described problem may easily occur in a case of the belt conveyance apparatus including a belt with a relatively short peripheral length and a support roller with a relatively small diameter. However, the problem can generally occur to some degree or another with a belt conveyance apparatus.

SUMMARY OF THE INVENTION

According to an aspect of the present invention, a belt conveyance apparatus includes a plurality of support rollers, an endless belt stretched around the plurality of support rollers, a regulation portion provided on an end portion side of at least one of the plurality of support rollers in a rotation axis direction, and configured to regulate a shift of the endless belt in a width direction, a regulation receiving member provided on an end portion side of the endless belt in a width direction, and configured to contact the regulation portion to receive a regulation force by the regulation portion, and support members disposed on an upstream side, in a conveyance direction of the endless belt, of the support rollers provided with the regulation portion to oppose each other on an inner peripheral surface side and an outer peripheral surface side of the end portion side of the endless belt in the width direction, and configured to regulate a position of the regulation receiving member when the regulation receiving member enters a contact portion with the regulation portion.

According to another aspect of the present invention, an image forming apparatus includes an information forming unit configured to form an toner image and the conveyance apparatus according to the present invention described above.

Further features of the present invention will become apparent from the following description of exemplary embodiments with reference to the attached drawings.

DESCRIPTION OF THE EMBODIMENTS

Hereinbelow, a belt conveyance apparatus and an image forming apparatus according to exemplary embodiments of the present invention will be described in detail with reference to the drawings.

1. Overall Configuration and Operation of Image Forming Apparatus

Figure 1:
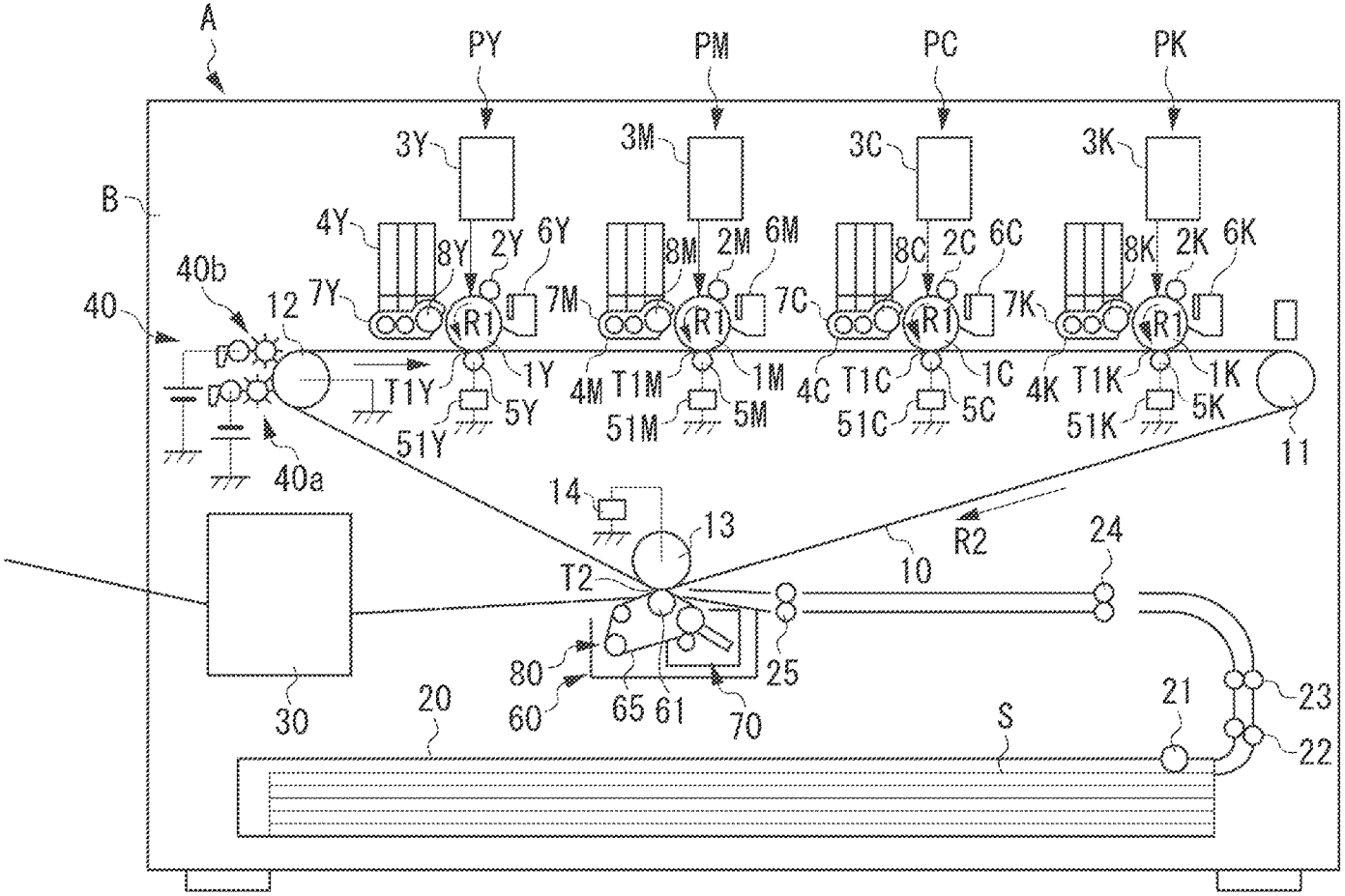
FIG. 1 is a cross sectional view schematically illustrating an image forming apparatus.

FIG. 1 is a cross sectional view schematically illustrating an image forming apparatus according to a first exemplary embodiment of the present invention. An image forming apparatus A according to the present exemplary embodiment is multicolor image forming apparatus (laser beam printer) capable of forming a full color image, employing an intermediate transfer method and a tandem system, using an electrophotographic image forming process.

An image forming apparatus A includes four image forming units PY, PM, PC, PK as an image forming means in an apparatus main body B, described below. The image forming units PY, PM, PC, PK are serially arranged along a moving direction (conveyance direction) of an image transfer surface (substantially horizontal direction) of an intermediate transfer belt 10 described below. These image forming units PY, PM, PC, PK respectively form yellow (Y), magenta (M), cyan (C), and black (K) toner images. In the present exemplary embodiment, configurations and operations of these image forming units PY, PM, PC, and PK are the same except for used colors of toners. Therefore, hereinbelow, suffixes Y, M, C, and K added to indicate the colors to the ends of symbols are omitted when it is not necessary to specifically discriminate colors, and the components are integrally described.

An image forming unit P includes a rotatable photosensitive drum 1 (i.e., image bearing member) having a drum shape (cylindrical form), which is electrophotographic photosensitive member. The photosensitive drum 1 is driven to rotate in a direction indicated by an arrow R1 in FIG. 1 at a predetermined circumferential speed. The following process devices are sequentially arranged around the photosensitive drum 1 along the rotational direction thereof. First, a charging roller (charger) 2, which is a charging member in a roller shape, is arranged as a charging means (unit). Next, the exposure unit (i.e., laser scanner unit) 3 is arranged as an exposure means (i.e., electrostatic image forming unit). Next, a developing unit 4 is arranged as a developing means. Next, a primary transfer roller 5 is arranged as a primary transfer means (unit), which is a primary transfer member in a roller shape. Next, a drum cleaning device 6 is arranged as a photosensitive member cleaning means (unit). In addition, yellow, magenta, cyan, and black toners are stored as developers in the developing units 4 of the image forming units P, respectively.

Further, the image forming apparatus A includes the intermediate transfer belt 10 as an intermediate transfer member, which is formed of an endless belt (belt member), in the apparatus main body B. The intermediate transfer belt 10 is wound around a plurality of support rollers (i.e., support members or tension rollers) such as a drive roller 11, a tension roller 12, and a secondary transfer inner roller 13. The intermediate transfer belt is formed of an elastic material, and biased by the tension roller 12 from inside toward outside thereof. Thus, the intermediate transfer belt 10 is stretched around the above-described three support rollers with a certain tensile force. The intermediate transfer belt 10 has a predetermined peripheral length and rotates (circles, runs) in a direction indicated by an arrow R1 illustrated in FIG. 1 at a predetermined circumferential speed, when the drive roller 11 is driven to rotate. Each primary transfer roller 5 described above is arranged at a position opposing photosensitive drum 1 on the inner peripheral surface side (back side) of the intermediate transfer belt 10. The primary transfer roller 5 is biased (pressed) via intermediate transfer belt 10 toward the photosensitive drum 1 to form a primary transfer portion (primary transfer nip portion) T1 at which the intermediate transfer belt 10 and the photosensitive drum 1 contact each other. Further, on the outer peripheral surface (front surface) side of the intermediate transfer belt 10, at the opposing position of the secondary transfer inner roller 13, a secondary transfer device 60 (described below) is disposed. Thus, a secondary transfer belt 65 (described below) and the intermediate transfer belt 10 contact each other to form a secondary transfer portion (secondary transfer nip portion) T2. Further, on the outer peripheral surface (front surface) side of the intermediate transfer belt 10, at a position opposing the tension roller 12, an intermediate transfer belt cleaning device 40 (described below) is disposed as an intermediate transfer member cleaning means (unit).

Other than those, the image forming apparatus A includes a paper feed unit for feeding a recording medium S, which is a transfer medium on which a toner image is transferred, to the secondary transfer portion T2, and a fixing unit for fixing a toner image on the recording medium S.

The front surface of the photosensitive drum 1 rotating during image formation is subjected to uniform charging processing by the charging roller 2. On the front surface of the photosensitive drum 1, the exposure device 3 projects (scanning exposure) a laser beam, via a polygon mirror and the like, corresponding to each image signal of an original of a color of the image forming unit P to form an electrostatic latent image (electrostatic image). The electrostatic latent image formed on the front surface of the photosensitive drum 1 is developed (visualized) as a toner image by the developing unit 4 supplying toner thereto as a developer. The toner image formed on the front surface of the photosensitive drum 1 is conveyed to the primary transfer portion T1 along with the rotation of the photosensitive drum 1. Then, the toner image is transferred (primary transferred) onto the front surface of the intermediate transfer belt 10 due to the operation of the primary transfer roller 5 at the primary transfer portion T1. At that time, a primary transfer voltage (primary transfer bias) is applied to the primary transfer roller 5. The primary transfer voltage has an opposite polarity with respect to a charging polarity (normal charging polarity, i.e., a negative polarity in the present exemplary embodiment) of the toner at the developing time. When a full color image is formed, at the image forming units PY, PM, PC, and PK, toner images formed on the photosensitive drum 1Y, 1M, 1C, and 1K are sequentially transferred onto the intermediate transfer belt 10 in an overlapping manner.

On the other hand, a recording medium S (e.g., recording paper) is fed from a paper cassette 20 by a paper feeding roller 21, and conveyed by other conveyance rollers 22 to 25. The recording medium S is thus conveyed to the secondary transfer portion T2 at a timing corresponding to a timing at which the toner image on the intermediate transfer belt 10 is conveyed to the secondary transfer portion T2. The secondary transfer device 60 is disposed at the secondary transfer portion T2 to nip the intermediate transfer belt 10 between the secondary transfer inner roller 13 and the secondary transfer device 60. As will be described in detail below, in the present exemplary embodiment, a secondary transfer roller 61 of the secondary transfer device 60 is disposed to oppose the secondary transfer inner roller 13 via the intermediate transfer belt 10 and the secondary transfer belt 65 of the secondary transfer device 60. The secondary transfer means is configured of the secondary transfer inner roller 13 and the secondary transfer device 60. Then, a secondary transfer voltage (secondary transfer bias) is applied to the secondary transfer inner roller 13. The secondary transfer voltage has a same polarity as the charging polarity of the toner at the developing time. With this operation, the toner image on the intermediate transfer belt 10 is transferred (secondary transferred) onto the recording medium S.

The recording medium S on which the toner image has been transferred is conveyed to a fixing unit 30 (i.e., fixing means). The fixing unit 30 fixes the toner image onto the recording medium S with heat and pressure. Then, the recording medium S is discharged to the outside of the apparatus main body B of the image forming apparatus A.

The transfer residual toner remaining on the photosensitive drum 1 without being transferred onto the intermediate transfer belt 10 at the primary transfer portion T1 is cleaned with the drum cleaning device 6. On the other hand, the transfer residual toner remaining on the intermediate transfer belt 10 without being transferred onto the recording medium S at the secondary transfer portion T2 is cleaned with the intermediate transfer belt cleaning device 40 serving as an intermediate transfer member cleaning means (unit). In the present exemplary embodiment, the intermediate transfer belt cleaning device 40 is configured of an upstream cleaning device 40*a* and a downstream cleaning device 40*b*. The upstream cleaning device 40*a* and the downstream cleaning device 40*b* are respectively disposed on the upstream side and the downstream side in the conveyance direction of the intermediate transfer belt 10.

In the present exemplary embodiment, the photosensitive drum 1 includes an aluminum cylinder of 80 mm in diameter with its outer peripheral surface being coated with an organic photoconductor (OPC) layer. Both end portions in the rotation axis direction of the photosensitive drum 1 are rotatably supported by the flanges, and the photosensitive drum 1 is driven to rotate in the arrow R1 direction (counterclockwise rotation) in FIG. 1 by the drive force transmitted to one end portion of the photosensitive drum 1 from the drive motor (not illustrated) as a drive means (unit). In the present exemplary embodiment, the charging polarity of the photosensitive drum 1 is a negative polarity.

In addition, the charging roller 2 is a conductive roller formed in a roller shape. The charging roller 2 is brought into contact with the front surface of the photosensitive drum 1, and a charging voltage (charging bias) is applied from a charging voltage source (not illustrated) serving as an application means (unit). Thus, the surface of the photosensitive drum 1 is uniformly charged in the negative polarity.

The exposure device 3 radiates a laser beam onto the photosensitive drum 1 via a polygon mirror. The laser beam has been subjected to turning-ON control by a drive circuit according to an image signal.

Further, the developing unit 4 includes a toner storage unit 7 and a developing roller 8. The toner storage unit 7 stores toner of a negative charging polarity. The developing roller 8, disposed adjacent to the front surface of the photosensitive drum 1, performs developing by a developing voltage (developing bias) applied thereto by a developing voltage source (not illustrated) as an application means.

Further, a primary transfer voltage source 51 serving as an application means (unit) is connected to the primary transfer roller 5. A direct current (DC) voltage of the positive polarity is applied to the primary transfer roller 5 from the primary transfer voltage source 51 as a primary transfer voltage. By the electric field generated at the primary transfer portion T1 due to this voltage, toner images with negative polarity formed on the photosensitive drums 1 are sequentially transferred onto the intermediate transfer belt 10 that is in contact with the photosensitive drum 1.

Further, a secondary transfer voltage source 14 is connected to the secondary transfer inner roller 13 as an application means (unit). A DC voltage with negative polarity is applied to the secondary transfer inner roller 13 from the secondary transfer voltage source 14 as a secondary transfer voltage. By the electric field generated at the secondary transfer portion T2 due to this voltage, toner images with negative polarity formed on the intermediate transfer belt 10 are sequentially transferred onto the recording medium S that is in contact with the intermediate transfer belt 10.

2. Secondary Transfer Device

Figure 2:
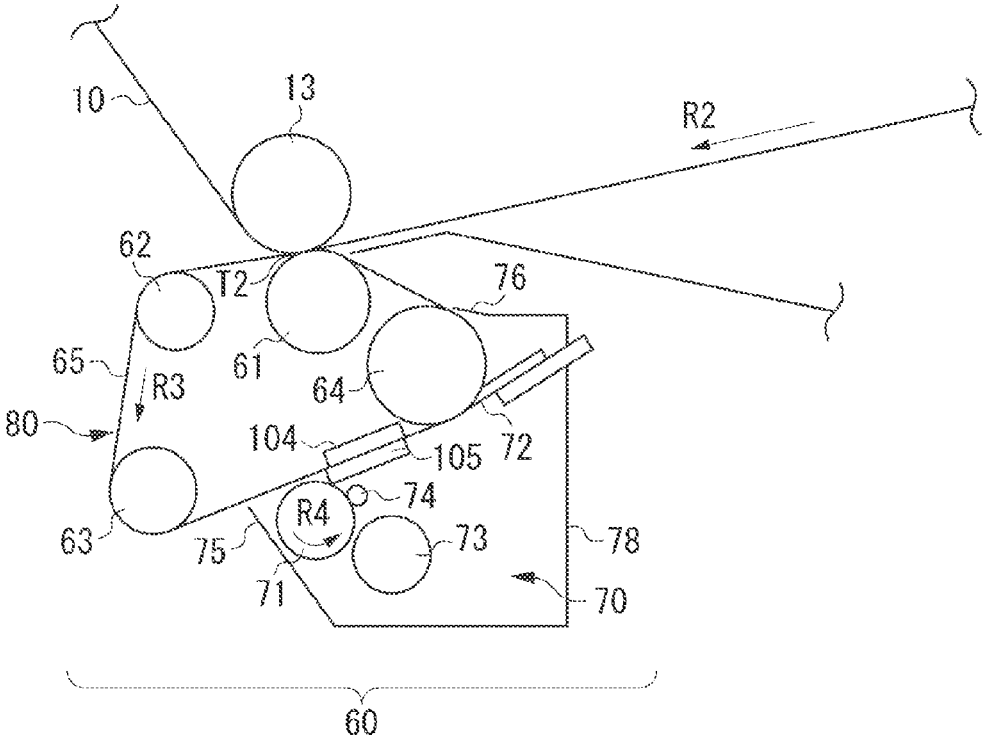
FIG. 2 is a cross sectional view schematically illustrating a secondary transfer device.

Next, the secondary transfer device 60 according to the present exemplary embodiment will be described. In the following description, the side corresponding to the front side of the image forming apparatus A in FIG. 1 is referred to as a front side, and the side corresponding to the back side thereof in FIG. 1 is referred to as a back side. The depth direction connecting the front side and the back side is substantially parallel with the direction (thrust direction) substantially orthogonal to the moving direction (conveyance direction) of the surfaces of the photosensitive drum 1, the intermediate transfer belt 10, and the secondary transfer belt 65. FIG. 2 is a cross sectional view illustrating the vicinity of the secondary transfer device 60 seen from the front side.

The secondary transfer device 60 mainly includes a belt unit 80 and a secondary transfer belt cleaner 70. The belt unit 80 includes the secondary transfer belt 65 as a recording medium conveyance member, and the secondary transfer belt cleaner 70 serves as a recording medium conveyance member cleaning means (unit). The secondary transfer belt cleaner 70 is disposed to oppose the outer peripheral surface of the secondary transfer belt 65 of the belt unit 80.

The belt unit 80 includes the secondary transfer belt 65 formed of an endless belt (belt member). The secondary transfer belt 65 is wound around a plurality of support rollers (i.e., support members and tension rollers) such as the secondary transfer roller 61, a separation roller 62, a tension roller 63, and a drive roller 64. At a position where the secondary transfer roller 61 opposes the secondary transfer inner roller 13 via the intermediate transfer belt 10 and the secondary transfer belt 65, the secondary transfer roller 61 is biased (pressed) toward the secondary transfer inner roller 13. With this configuration, the secondary transfer portion T2 is formed at which the intermediate transfer belt 10 and the secondary transfer belt 65 are in contact with each other. The separation roller 62 has a function of separating the recording medium S from the secondary transfer belt 65. The tension roller 63 is biased by a tension spring 85 serving as a biasing means (unit) illustrated in FIG. 3 to press the secondary transfer belt 65 from the inside toward the outside thereof, and gives a predetermined tension to the secondary transfer belt 65. With this configuration, the secondary transfer belt 65 is stretched around the above-described four support rollers with a predetermined tensile force. The secondary transfer belt 65 rotates (circles, runs) in a direction indicated by an arrow R3 in FIG. 2 by a secondary transfer belt drive motor (not illustrated) as a drive means (unit) driving the drive roller 64 to rotate.

As described above, the toner image formed on the intermediate transfer belt 10 is secondarily transferred onto the recording medium S fed to the secondary transfer portion T2. At this time, the recording medium S fed to the secondary transfer portion T2 is stuck to the secondary transfer belt 65. The recording medium S stuck to the surface of the secondary transfer belt 65 is conveyed from the secondary transfer portion T2 to the downstream by moving the secondary transfer belt 65 to the direction indicated by the arrow R3 in FIG. 2. Then, upon arriving at the position of the separation roller 62, the recording medium S on the secondary transfer belt 65 is separated due to the curvature of the separation roller 62 from the surface of the secondary transfer belt 65. Then, the recording medium S separated from the secondary transfer belt 65 is conveyed toward the fixing unit 30.

In the present exemplary embodiment, the secondary transfer roller 61 is formed of a core material (core metal) and three layers thereon. The three layers includes a sponge rubber as a lower layer, a solid rubber as a middle layer, and a fluorine coating as a surface layer, in this order from the core material side. In addition, in the present exemplary embodiment, the drive roller 64 includes a core material (core metal) and a rubber layer formed thereon to contact the back side of the secondary transfer belt 65. In addition, in the present exemplary embodiment, the separation roller 62 is a roller in a positive crown shape (i.e., the external diameter at the center portion thereof is larger than those at the end portions thereof in the rotation axis direction). In addition, in the present exemplary embodiment, the tension roller 63 is in an inverse crown shape (i.e., the external diameter at the center portion thereof is smaller than those at the end portions thereof in the rotation axis direction). In the present exemplary embodiment, the surfaces of the separation roller 62 and the tension roller 63 are formed of a hard metal. In the present exemplary embodiment, the secondary transfer belt is a polyimide resin belt. The secondary transfer belt 65 is shorter than the intermediate transfer belt 10 in peripheral length.

The secondary transfer belt cleaner 70 includes a container 78 as housing. In the container 78, the secondary transfer belt cleaner 70 includes a fur roller 71 as a first cleaning member, a cleaning blade 72 as a second cleaning member, a conveyance screw 73 as a toner conveyance member, and a scraper shaft 74. Nylon fibers (synthetic fibers) are implanted onto a conductive roller as a support member to form the fur roller 71. The fur roller 71 is disposed to friction the secondary transfer belt 65 while keeping an inroad amount of 1 mm with respect to the secondary transfer belt 65. The scraper shaft 74 is disposed to contact the fur roller 71. In the present exemplary embodiment, the scraper shaft 74 is formed of a metal roller. In the present exemplary embodiment, the fur roller 71 is driven to rotate in an arrow R4 direction in FIG. 2 by a drive motor (not illustrated) serving as a drive means (unit). The fur roller 71 is disposed in such a manner that the rotation axis direction thereof is disposed along the direction substantially orthogonal to the conveyance direction of the secondary transfer belt 65. On the other hand, the cleaning blade 72 is made of urethane rubber, which is an example of rubber materials, and is press-contacted to the secondary transfer belt 65 at a predetermined contact angle and contact pressure. In other words, the cleaning blade 72 is a plate-shaped member of substantially rectangle shape in a planar view. More specifically, the cleaning blade 72 has a predetermined length in the lengthwise direction disposed along the direction substantially orthogonal to the conveyance direction of the secondary transfer belt 65, a predetermined length in the widthwise direction thereof substantially orthogonal to the lengthwise direction, and a predetermined thickness. The cleaning blade 72 is brought into contact with the secondary transfer belt 65 in such a manner that one end portion (free end portion) in the widthwise direction is directed to the upstream side in the conveyance direction of the secondary transfer belt 65 (i.e., counter contact).

In addition, the cleaning blade 72 is in contact with the secondary transfer belt 65, which is wound around the drive roller 64. In addition, the fur roller 71 is disposed on the upstream side of the cleaning blade 72 in the conveyance direction of the secondary transfer belt 65. Especially, in the present exemplary embodiment, the fur roller 72 contacts the stretching surface of the secondary transfer belt 65 between a position at which the secondary transfer belt 65 is wound around the tension roller 63 and a position at which the secondary transfer belt 65 is wound around the drive roller 64 in the conveyance direction thereof.

In such a configuration, when the toner image is secondarily transferred onto the recording medium S, paper dust adhered to the secondary transfer belt 65 is removed by the fur roller 71, and the paper dust adhered to the fur roller 71 is scraped down by the scraper shaft 74. Meanwhile, the transfer residual toner adhered to the secondary transfer belt 65 is removed therefrom by the rotation of the secondary transfer belt 65 and the operation of the cleaning blade 72. Then, the removed toner is discharged to a collection portion (collected toner container) (not illustrated) using the conveyance screw 73, together with the paper dust removed by the fur roller 71.

Figure 3:
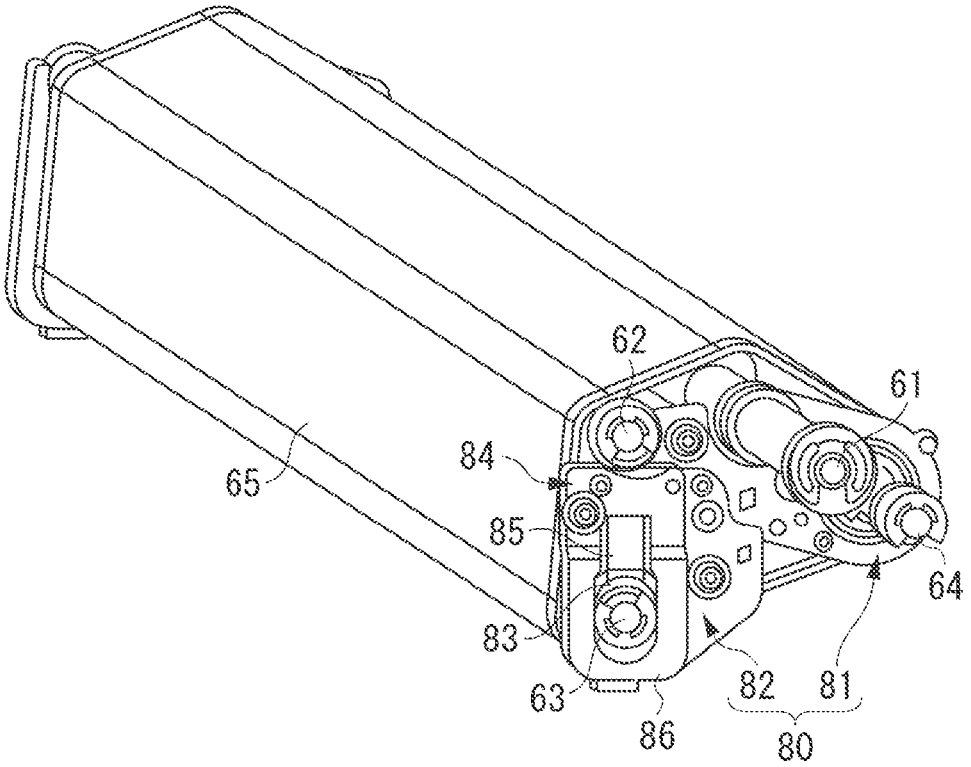
FIG. 3 is a perspective view illustrating a belt unit used in a secondary transfer device.

FIG. 3 is a perspective view illustrating the front side of the belt unit 80 as a belt conveyance apparatus, used in the secondary transfer device 60 according to the present exemplary embodiment. As illustrated in FIG. 3, the belt unit 80 includes the secondary transfer belt 65, a fixed roller unit 81, and a tension roller unit 82. The belt unit 80 is configured to be attachable and detachable to and from the secondary transfer device 60. In the fixed roller unit 81, the drive roller 64, the secondary transfer roller 61, and the separation roller 62 are respectively fixedly disposed to predetermined positions. This is because these positions affect the traveling performance of the secondary transfer belt 65, the positional accuracy of the secondarily transferred image, the separability of the recording medium S from the secondary transfer belt 65, and the transfer performance to the downstream units such as a conveyance means (unit) that conveys the recording medium S to the fixing unit 30. Meanwhile, in the tension roller unit 82, the tension roller 63 is movably held by a tension mechanism 84 that gives tension to the secondary transfer belt 65. The tension mechanism 84 includes the tension spring 85, a bearing 83, and a bearing retaining member 86.

3. Belt Shift Regulation Means

Next, the belt shift regulation means according to the present exemplary embodiment for regulating the shift of the secondary transfer belt 65 will be described. In the present exemplary embodiment, components configuring the belt shift regulation means at both end portions of the secondary transfer belt 65 in the width direction are substantially the same, i.e., symmetrical with reference to the center of the width direction of the secondary transfer belt 65. Therefore, the corresponding components provided at both end portions are designated the same numerals. In addition, in order to simplify the description, only the components provided at one end portion may be described from among the components provided at both end portions.

Figure 4:
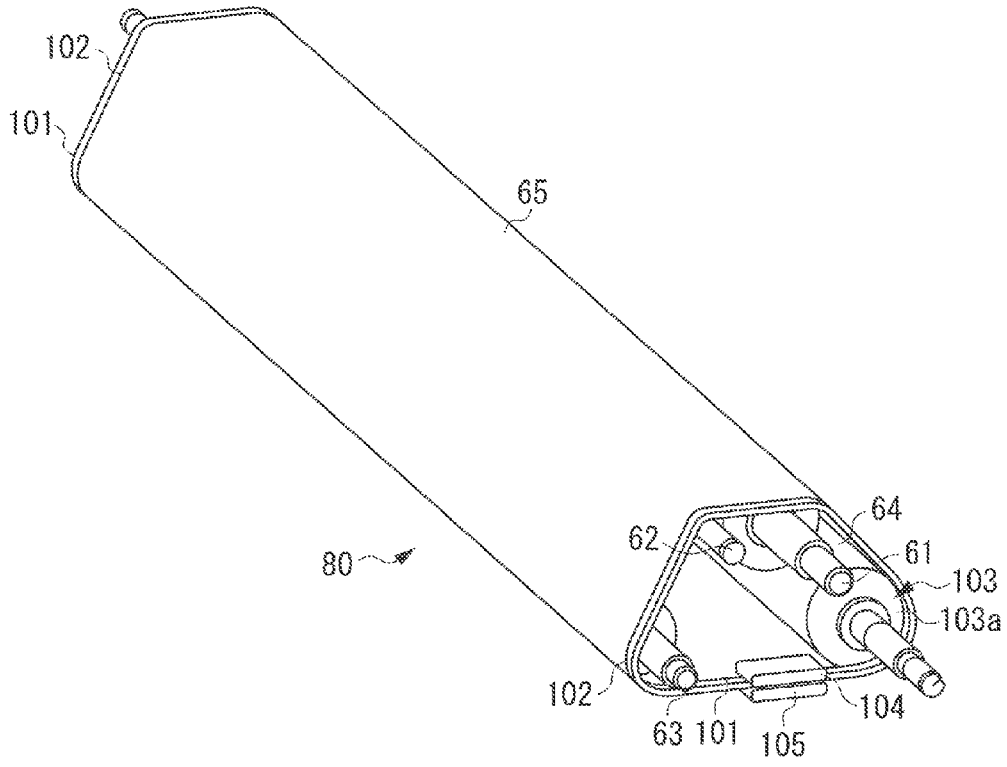
FIG. 4 is a perspective view illustrating a belt unit used in a secondary transfer device, with a part of members omitted.

FIG. 4 is a perspective view illustrating the belt unit 80 used in the secondary transfer device 60 according to the present exemplary embodiment, with some of the components omitted. In the present exemplary embodiment, a regulation rib 101 (regulation receiving member) made of urethane rubber is attached to the back side of each end portion of the secondary transfer belt 65 in a width direction. In the present exemplary embodiment, the regulation rib 101 is provided over the whole circumference of the secondary transfer belt 65. In addition, a reinforcing tape 102 as a reinforcing member made of polyethylene terephthalate (PET) is attached to the front surface of the secondary transfer belt 65 at each end portion in the width direction. In the present exemplary embodiment, the reinforcing tape 102 is provided over the whole circumference of the secondary transfer belt 65. Further, in the present exemplary embodiment, a regulation roller 103 as a regulation member is provided at each end portion of the drive roller 64 in the rotation axis direction. The regulation rib 101 regulates the running position of the secondary transfer belt 65 by contacting the regulation roller 103.

The regulation roller 103 includes an oblique surface (taper) 103*a* at each end portion. The oblique surface 103 inclines to increase the diameter toward the center side of the drive roller 64 in the rotation axis direction. Therefore, when the regulation rib 101 enters the regulation operation portion (i.e., contact portion with the regulation roller 103), the regulation rib 101 is brought into contact with the regulation roller 103 smoothly. This configuration can reduce the friction force acting between contact surfaces of the regulation rib 101 and the regulation roller 103, and can reduce the force acting toward the direction to raise the regulation rib 101 on the regulation roller 103. In addition, in the present exemplary embodiment, the regulation roller 101 is made of polyacetal (POM) with a relatively low friction coefficient. Reducing the friction coefficient between the regulation roller 103 and the regulation rib 101 prevents the regulation rib 101 from biting the regulation roller 103. Providing the oblique surface 103*a* and reducing the friction coefficient reduce the occurrence risk of riding-on the secondary transfer belt 65. In the present exemplary embodiment, the regulation rib 101 made of urethane rubber disposed at each end portion of the secondary transfer belt 65 in the width direction is 1.2 mm in thickness (height from the back surface of the secondary transfer belt 65) before use. Thus, both the belt shift regulation and the high durability can be achieved.

Figure 13:
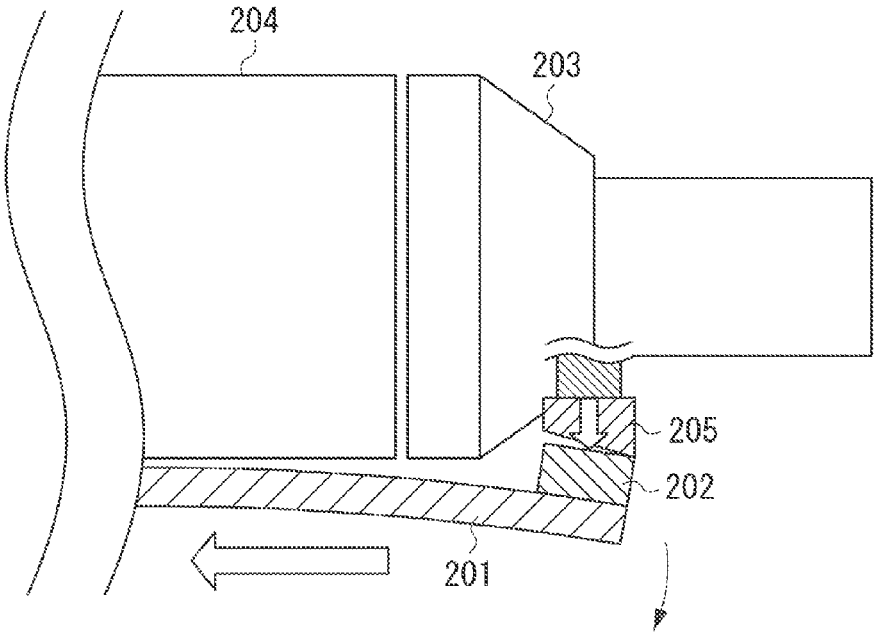
FIG. 13 is a cross sectional view schematically illustrating a belt expanded state at an end portion thereof.
Figure 14:
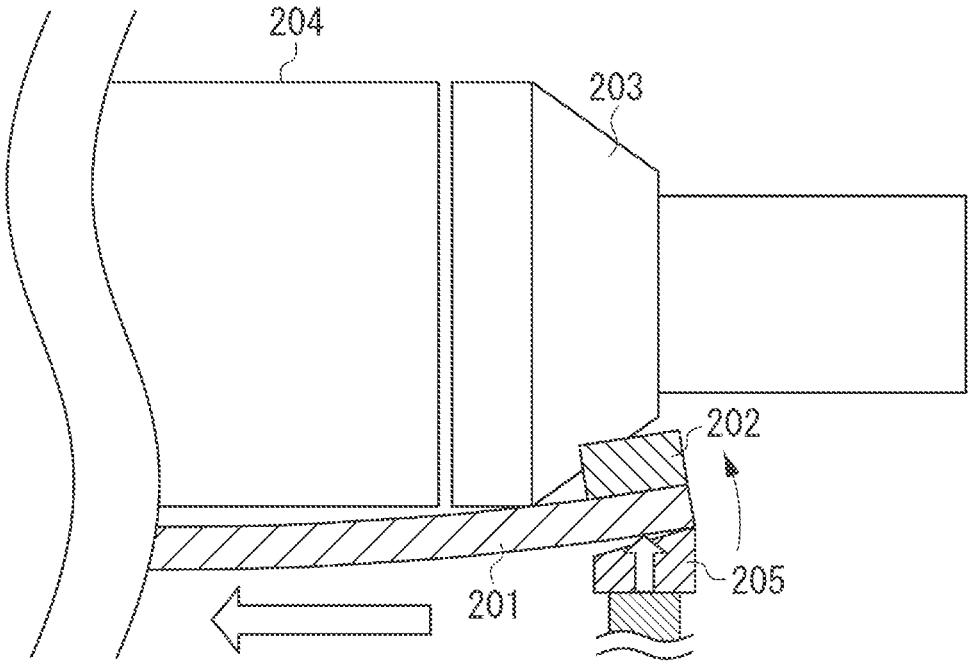
FIG. 14 is a cross sectional view schematically illustrating a belt pressed and narrowed state at an end portion thereof.

As described above, it is not preferable for the regulation rib 101 disposed at each end portion of the secondary transfer belt 65 in the width direction to enter the regulation operation portion, which is a contact portion of the regulation rib 101 and the regulation roller 103, in a state where the regulation rib 101 is deformed toward the outside or inside of the secondary transfer belt 65. In a case where the end portion of the secondary transfer belt 65 in the width direction is deformed to expand from the inside toward the outside (see FIG. 13), the position at which the regulation rib 101 is brought into contact with the regulation roller 103 comes closer to the outer periphery side of the regulation roller 103. In this case, the regulation force between the regulation roller 103 and the regulation rib 101 is reduced, and when the deformation amount is large, the regulation rib 101 may not contact the regulation roller 103. Further, in a case where the end portion of the secondary transfer belt 65 in the width direction is deformed so as to be pressed and narrowed from the outside toward the inside (see FIG. 14), the position at which the regulation rib 101 is brought into contact with the regulation roller 103 moves toward the outer periphery side of the regulation roller 103. In this case, the friction force between the regulation rib 101 and the regulation roller 103 increases, which may cause the belt shift regulation to be unstable. To restrain this problem, it is desired to correct the attitude of the regulation rib 101 at the time of entering the regulation operation portion.

Herein, a scattering prevention member made of fur or felt may be disposed on the front surface and the inner surface of each end portion of the secondary transfer belt 65 in the width direction between the drive roller 64 and the tension roller 63, to prevent toner scattering to the inner surface of the secondary transfer belt 65 and other units. In a case where such a scattering prevention member is disposed to enter the secondary transfer belt 65, the end portion of the secondary transfer belt 65 in the width direction is deformed to expand. Further, as in the present exemplary embodiment, in a case where the tension roller 63 is formed in the inverse crown shape, similarly as described above, the end portion of the secondary transfer belt 65 in the width direction is deformed to expand. Further, in the present exemplary embodiment, the fur roller 71 is disposed on the front surface side of the secondary transfer belt 65 between the tension roller 63 and the regulation operation portion in the conveyance direction of the secondary transfer belt 65. In addition, the fur roller 71 is shorter than the secondary transfer belt 65 in the thrust direction. In addition, the configuration according to the present exemplary embodiment, a backup member cannot be disposed at an opposing position of the fur roller 71 across the secondary transfer belt 65. Therefore, with this configuration, similarly as described above, the end portion of the secondary transfer belt 65 in the width direction may be deformed to expand. Then, in a case of the belt unit 80 including a belt having a relatively shorter peripheral length and a support roller having a relatively smaller diameter according to the present exemplary embodiment, a conveyance distance of the secondary transfer belt 65 sufficient to be back to the correct attitude of the end portion thereof in the width direction, cannot be secured. Therefore, this configuration is susceptible to these influences. In addition, from the viewpoint of the stability of the belt shift regulation, the regulation rib 101 is more advantageous as it is thicker. However, in the belt unit including a belt having a relatively shorter peripheral length and a support roller having a relatively smaller diameter, the secondary transfer belt 65 has a small curvature. Therefore, it is difficult, in consideration of the durability, to further increase the thickness of the regulation rib 101.

4. Support Member

Figure 5B:
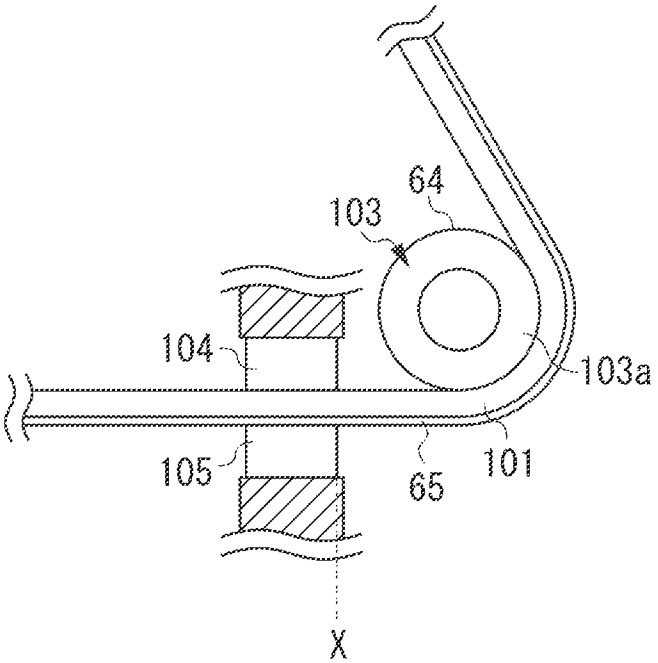
FIGS. 5A and 5B are a cross sectional view and a side view schematically illustrating an example of a support member for stabilizing belt shift regulation.
Figure 5A:
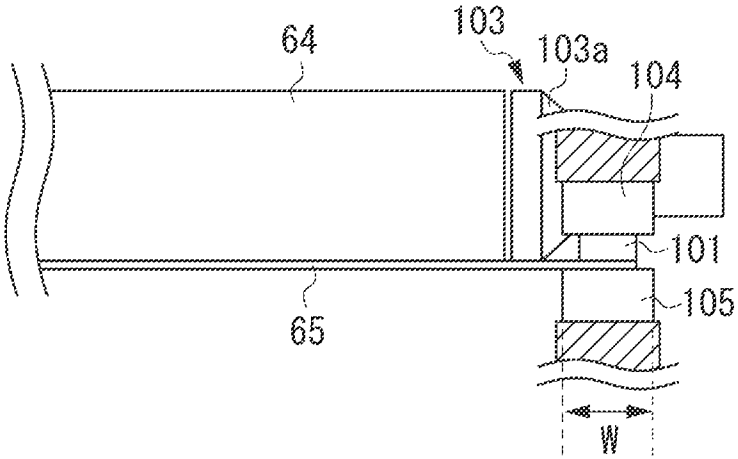

Next, referring to FIGS. 4, 5A, and 5B, a configuration to stabilize belt shift regulation according to the present exemplary embodiment, will be described. FIG. 5A is a schematic cross sectional view of the vicinity of the regulation operation portion by the belt shift regulation means (cross section in the vicinity of the drive roller 64 and on the upstream side of the secondary transfer belt 65 in the conveyance direction), and FIG. 5B is a schematic side view seen from the front side. In addition, FIGS. 6A and 6B to FIGS. 10A and 10B (described below) are similar to FIGS. 5A and 5B.

In the present exemplary embodiment, a back surface side support member 104 and a front surface side support member 105 are arranged in the vicinity of the regulation operation portion and on the upstream side of the secondary transfer belt 65 in the conveyance direction to sandwich the end portion of the secondary transfer belt 65 in the width direction between the back surface side (inner peripheral surface side) and the front surface side (outer peripheral surface side). The back surface side support member 104 and the front surface side support member 105 respectively contact the back surface side and the front surface side of the secondary transfer belt 65 at a predetermined position at which the regulation rib 101 can enter a desired position on the regulation roller 103 to contact them. In this way, the attitude of the regulation rib 101 when the regulation rib 101 enters the regulation operation portion (i.e., contact portion of the regulation rib 101 and the regulation roller 103), can be regulated and stabilized. Thus, the belt shift regulation can be stabilized. The back surface side support member 104 and the front surface side support member 105 can be disposed by fixing to a frame (i.e., chassis, not illustrated) of the belt unit 80 or the like. The back surface side support member 104 and the front surface side support member 105 may respectively be provided to constantly contact the secondary transfer belt 65, or to contact the secondary transfer belt 65 when the secondary transfer belt 65 is deformed as described above.

The back surface side support member 104 and the front surface side support member 105 are disposed to sandwich the regulation rib 101 or the vicinity thereof at the end portion of the secondary transfer belt 65 in the width direction. In this way, the deformation of the secondary transfer belt 65 inward and outward thereof can be regulated. Further, the secondary transfer belt 65 can be prevented from being pressed from inner side or outer side thereof. At that time, if the regulation rib 101 presses the regulation operation portion, which is in contact with the regulation roller 103, the regulation rib 101 is deformed inward, and the belt shift regulation becomes unstable with the reason described above. Therefore, in particular, the front surface side support member 105 is regulated not to enter the opposing position of the regulation operation portion.

In the present exemplary embodiment, the back surface side support member 104 and the front surface side support member 105 are respectively disposed to oppose each other at a position at which at least a part of the back surface side support member 104 and the front surface side support member 105 overlap the regulation rib 101 in the width direction. Especially, in the present exemplary embodiment, the widths W of the back surface side support member 104 and the front surface side support member 105 in the width direction of the secondary transfer belt 65 are almost the same, and the width of the regulation rib 101 is determined to be similar to the width W or smaller than the width W, in this direction. In this way, the effect of regulating the attitude of the regulation rib 101 is enhanced.

Further, the back surface side support member 104 and the front surface side support member 105 are disposed at a position immediately before the position at which the regulation rib 101 enters the regulation operation portion. In other words, the back surface side support member 104 and the front surface side support member 105 are disposed between the drive roller 64 and the tension roller 63 disposed on the upstream side thereof in the conveyance direction of the secondary transfer belt 65. In this way, the back surface side support member 104 and the front surface side regulation member 105 are provided at a part of the region in a circumferential direction of the secondary transfer belt 65 (i.e., not all region). Therefore, the configuration can be implemented with relatively a low cost. At that time, it is desirable that the positions X of the downstream side end portions of the back surface side support member 104 and the front surface side support member 105 in the conveyance direction of the secondary transfer belt 65 substantially match each other. In this way, the attitude of the regulation rib 101 immediately before entering the regulation operation portion can be regulated more securely. From this viewpoint, it is desirable for at least the above-described positions X of the back surface side support member 104 and the front surface side support member 105 to be disposed as close as possible to the drive roller 64 between the drive roller 64 and the tension roller 63 disposed on the upstream side of the drive roller 64 in the conveyance direction of the secondary transfer belt 65.

As described above, in the present exemplary embodiment, the belt unit 80 (i.e., belt conveyance apparatus) includes the secondary transfer roller 61, the separation roller 62, the tension roller 63, and the drive roller 64 (i.e., a plurality of support rollers), and an endless belt (secondary transfer belt 65) stretched around the plurality of support rollers 61, 62, 63, and 64. Further, the belt unit 80 includes a regulation portion (regulation roller) 103 for regulating the shift of the secondary transfer belt 65 in the width direction thereof, which is disposed on the end side portion of the drive roller 64 (i.e., at least one of the plurality of support rollers 61, 62, 63, and 64) in the rotation axis direction. Further, the belt unit 80 includes a regulation receiving member (the regulation rib 101) for receiving the regulation force applied by the regulation portion 103, by contacting the regulation portion 103. The regulation rib 101 is provided on the end side of the secondary transfer belt 65 in the width direction. Further, the belt unit 80 includes the back surface side support member 104 and the front surface side support member 105 respectively arranged on the inner peripheral surface side and the outer peripheral surface side on the end portion in the width direction of the secondary transfer belt 65 opposing each other, on the upstream side, in the conveyance direction of the secondary transfer belt 65, of the support roller (drive roller) 64 on which the regulation portion 103 is provided. These support members 104 and 105 regulates the position of the regulation receiving member 101 when the regulation receiving member 101 enters the contact portion with the regulation portion 103. In the present exemplary embodiment, the regulation receiving member 101 is a rib disposed on the inner peripheral surface side of the secondary transfer c along the conveyance direction thereof. In the present exemplary embodiment, the support members 104 and 105 are disposed, which are respectively arranged on the inner peripheral surface side and the outer peripheral surface side of the secondary transfer belt 65, to at least partly overlap the regulation rib 101 in the width direction.

Typically, at least one of the support members 104 and 105, which are arranged on the inner peripheral surface side and the outer peripheral surface side of the secondary transfer belt 65, is made of an elastic member. In the present exemplary embodiment, felt is used as an elastic member for the support members 104 and 105. However, any material can be used for the support members 104 and 105 as long as it can support the secondary transfer belt 65 to regulate the attitude thereof.

When the scattering prevention member like described above is provided, the scattering prevention member can be also used as the back surface side support member 104. When such a member functioning as the back surface side support member 104 does not exist, the back surface side support member 104 is additionally provided at an opposing position of the front surface side support member 105 across the secondary transfer belt 65.

As described above, according to the present exemplary embodiment, the regulation rib 101 can enter the regulation operation portion with a correct attitude. Thus, the stabilized belt shift regulation can be achieved.

Next, a second exemplary embodiment of the present invention is described. The basic configuration and the operation of the belt conveyance apparatus and the image forming apparatus according to the present exemplary embodiment are similar to those according to the first exemplary embodiment. Therefore, elements including the same or corresponding functions and configurations as or to those in the first exemplary embodiment are denoted the same numerals, and the detailed descriptions thereof are omitted.

Figure 6B:
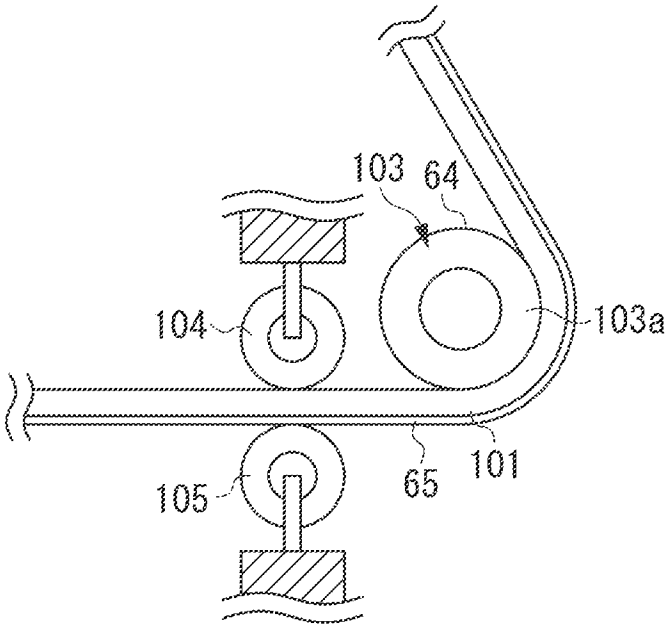
FIGS. 6A and 6B are a cross sectional view and a side view schematically illustrating another example of a support member for stabilizing belt shift regulation.
Figure 6A:
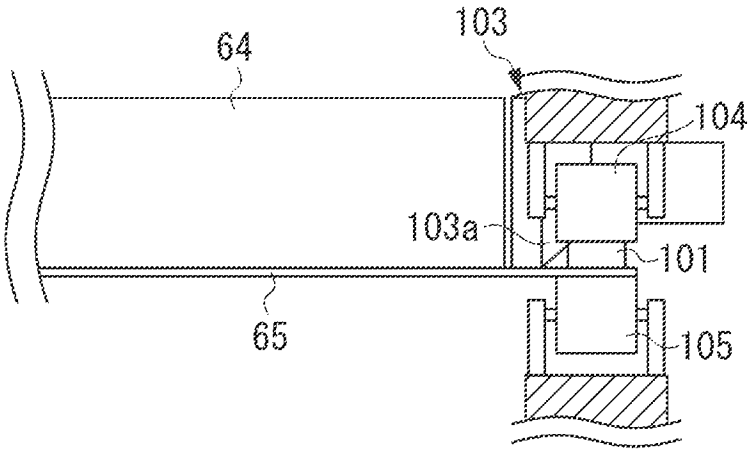

FIGS. 6A and 6B illustrate a configuration of the present exemplary embodiment. As illustrated in FIGS. 6A and 6B, at least one of the back surface side support member 104 and the front surface side support member 105 can be formed as a roller. In the present exemplary embodiment, both of the back surface side support member 104 and the front surface side support member 105 are formed as rollers. The rotation axis directions of the rollers are substantially parallel to the rotation axis directions of the support rollers of the secondary transfer belt 65. Similar to the first exemplary embodiment, these rollers are respectively brought into contact with the back surface side and the front surface side of the secondary transfer belt 65 at positions corresponding to predetermined positions that are determined so that the regulation rib 101 can enter and contact the desired position of the regulation roller 103. In addition, similar to the first exemplary embodiment, these rollers desirably have, for example, substantially the same width as the regulation rib 101. Further, as these rollers have larger diameters, the distance of the nip portion, which is a contact portion with a supported object, becomes wider. Therefore, it is easier to control the attitude.

In the present exemplary embodiment, these rollers are disposed to be rotatable, but they may not be rotatable. In such a case, it is desirable to use a member having relatively a smaller frictional sliding friction. If the rollers are configured to be rotatable, deterioration of the durability due to a friction can be reduced.

As described above, in the present exemplary embodiment, at least one of the support members 104 and 105 that are respectively arranged on the inner peripheral surface side and the outer peripheral surface side is made of a roller. According to the present exemplary embodiment, a similar effect to that of the first exemplary embodiment can be obtained. Further, if rotatable rollers are used, it is possible to reduce the frictional sliding of the secondary transfer belt 65 by regulating the attitude of the regulation rib 101.

Next, a third exemplary embodiment of the present invention is described. The basic configuration and the operation of the belt conveyance apparatus and the image forming apparatus according to the present exemplary embodiment are similar to those according to the first exemplary embodiment. Therefore, elements including the same or corresponding functions and configurations as or to those in the first exemplary embodiment are denoted the same numerals, and the detailed descriptions thereof are omitted.

Figure 7B:
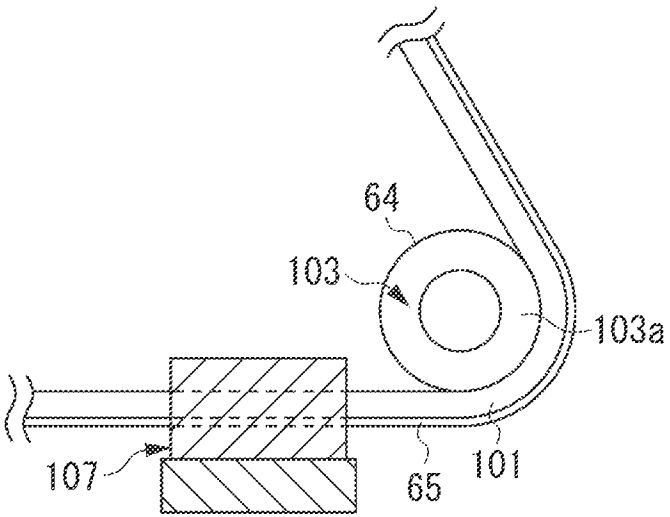
FIGS. 7A and 7B are a cross sectional view and a side view schematically illustrating yet another example of a support member for stabilizing belt shift regulation.
Figure 7A:
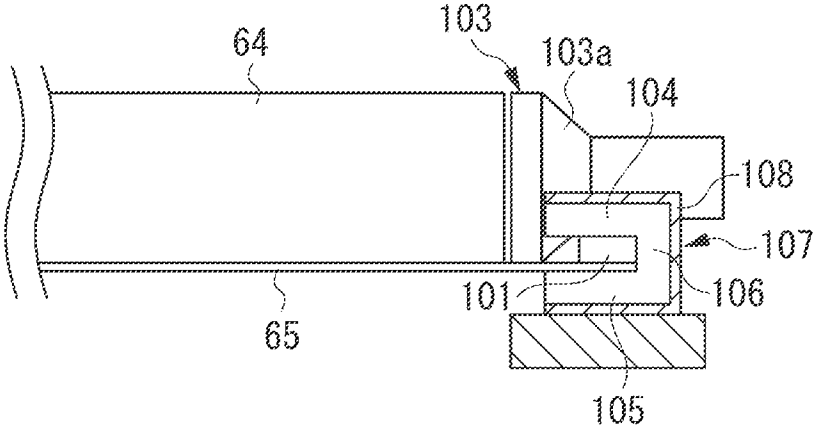

FIGS. 7A and 7B illustrate a configuration according to the present exemplary embodiment. As illustrated in FIGS. 7A and 7B, in the present exemplary embodiment, the back surface side support member 104 and the front surface side support member 105 are integrally connected with a connection portion 106 to be one front-and-back surface side support member 107. The connection portion 106 is provided outside of fur secondary transfer belt 65 in a width direction. Then, the front-and-back surface side support member 107 sandwiches the end portion of the secondary transfer belt 65 in the width direction to hold the attitude of the regulation rib 101. At that time, as illustrated in FIG. 7A, the effect of holding the attitude can be enhanced by providing a reinforcing member 108 on the outside surface of the front-and-back surface side support member 107 described above.

In this way, in the present exemplary embodiment, the support members 104 and 105 respectively disposed on the inner peripheral surface side and the outer peripheral surface side are integrally connected. According to the present exemplary embodiment, a similar effect to that of the first exemplary embodiment can be achieved, and in addition thereto, the number of members can be reduced. Accordingly, the alignment of the support members respectively arranged on the back surface side and the front surface side of the secondary transfer belt 65 can be simplified. As a result, the accuracy of the alignment can be enhanced.

Next, a fourth exemplary embodiment of the present invention is described. The basic configuration and the operation of the belt conveyance apparatus and the image forming apparatus according to the present exemplary embodiment are similar to those according to the first exemplary embodiment. Therefore, elements including the same or corresponding functions and configurations as or to those in the first exemplary embodiment are denoted the same numerals, and the detailed descriptions thereof are omitted.

Figure 8B:
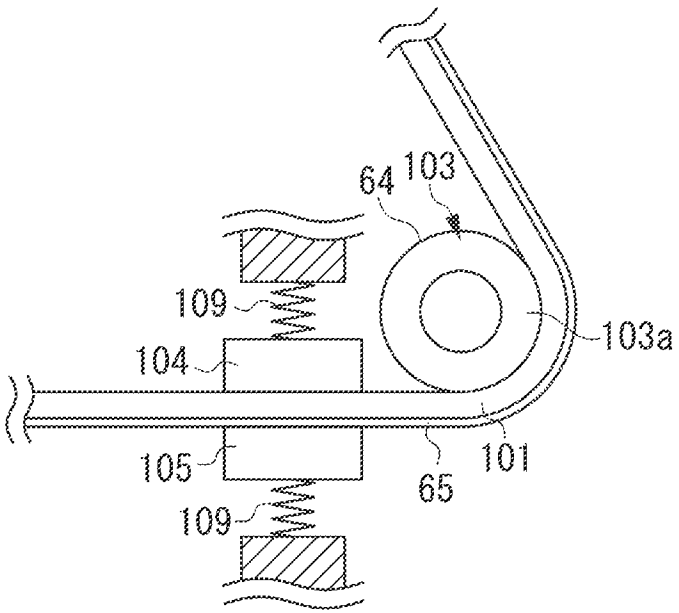
FIGS. 8A and 8B are a cross sectional view and a side view schematically illustrating yet another example of a support member for stabilizing belt shift regulation.
Figure 8A:
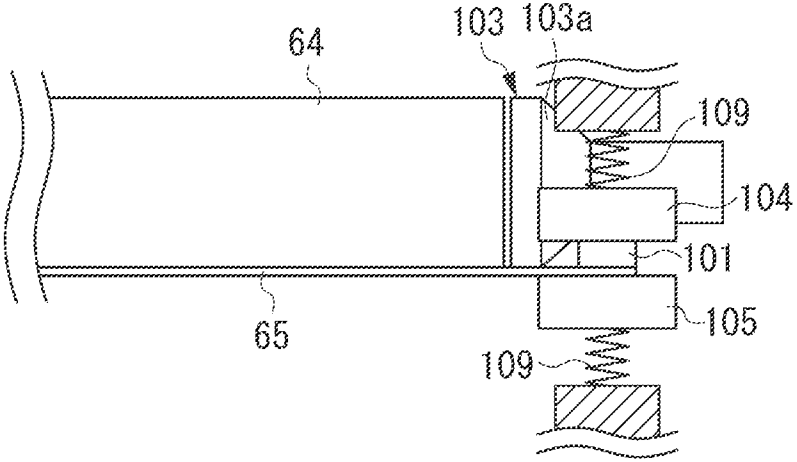

FIGS. 8A and 8B illustrate a configuration according to the present exemplary embodiment. As illustrated in FIGS. 8A and 8B, at least one of the back surface side support member 104 and the front surface side support member 105 can be biased with a spring 109 and the like. In the present exemplary embodiment, both of the back surface side support member 104 and the front surface side support member 105 are biased respectively with the springs 109 toward the secondary transfer belt 65.

In this way, in the present exemplary embodiment, at least one of the support members 104 and 105 respectively arranged on the inner peripheral surface side and the outer peripheral surface side of the secondary transfer belt 65 is biased by biasing means toward the secondary transfer belt 65. According to the present exemplary embodiment, a similar effect to that of the first exemplary embodiment can be achieved, and in addition thereto, the load applied to the support members 104 and 105 when an excessive deformation is temporarily caused on the secondary transfer belt 65, can be reduced. As a result, the durability of the secondary transfer belt 65, and the support members 104 and 105 can be enhanced.

Next, a fifth exemplary embodiment of the present invention is described. The basic configuration and the operation of the belt conveyance apparatus and the image forming apparatus according to the present exemplary embodiment are similar to those according to the first exemplary embodiment. Therefore, elements including the same or corresponding functions and configurations as or to those in the first exemplary embodiment are denoted the same numerals, and the detailed descriptions thereof are omitted.

Figure 9B:
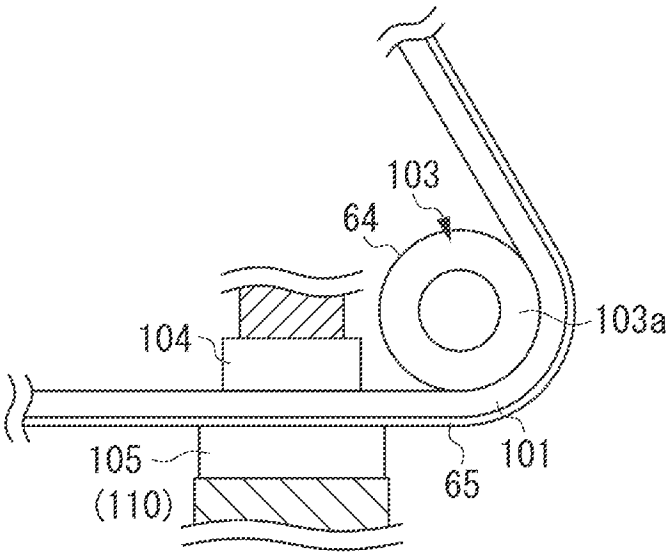
FIGS. 9A and 9B are a cross sectional view and a side view schematically illustrating yet another example of a support member for stabilizing belt shift regulation.
Figure 9A:
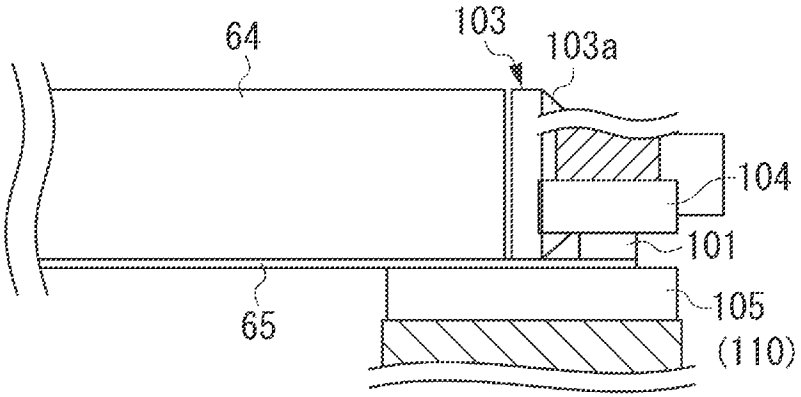

FIGS. 9A and 9B illustrate a configuration of the present exemplary embodiment. In the present exemplary embodiment, at least one of the back surface side support member 104 and the front surface side support member 105 has a function of a scattering prevention member. The scattering prevention member is an example of a blocking member for blocking powder such as developer including toner and external additives, and paper dust, from moving to the width direction of the secondary transfer belt 65. As one example, in the present exemplary embodiment, the scattering prevention member (in the present exemplary embodiment, a fur brush) 110 is disposed so as to contact the end portion of the fur roller 71 in the rotation axis direction. The length of the fur roller 71 in the rotation axis direction is shorter than the width of the secondary transfer belt 65. Therefore, the end portion of the scattering prevention member 110 on the center side of the secondary transfer belt 65 in the width direction, is shifted to the center side thereof with respect to the regulation rib 101. Therefore, according to the present exemplary embodiment, the end portion of the scattering prevention member 110 is elongated to the end portion of the secondary transfer belt 65 in the width direction thereof. In this way, the scattering prevention member 110 can function as the front surface side support member 105. The length of the scattering prevention member 110 (the front surface side support member 105) in the width direction of the secondary transfer belt 65 can be arbitrarily determined, and therefore, the scattering prevention member 110 can be elongated to a required position.

In this case, if the inroad amount with respect to the secondary transfer belt 65 as the scattering prevention member 110 is the same inroad amount, the scattering prevention member 110 may push up the end portion of the secondary transfer belt 65 in the width direction. In such a case, the inroad amount can be adjusted by, for example, lowering the adhesion surface of the scattering prevention member 110 to a fixing portion.

In this way, in the present exemplary embodiment, at least one of the support members 104 and 105 respectively disposed on the inner peripheral surface side and the outer peripheral surface side of the secondary transfer belt 65 functions as the blocking member for blocking the movement of the powder in the width direction of the secondary transfer belt 65. According to the present exemplary embodiment, an effect similar to that of the first exemplary embodiment can be achieved, and also, an effect of achieving the scattering prevention of toner and the belt shift regulation can be achieved at a same time. As a result, the number of members can be reduced. Further, toner on the end portion of the secondary transfer belt 65 in the width direction can be collected by using felt or slidable sponge in place of or in addition to the fur brush as the scattering prevention member (support member).

Next, a sixth exemplary embodiment of the present invention is described. The basic configuration and the operation of the belt conveyance apparatus and the image forming apparatus according to the present exemplary embodiment are similar to those according to the first exemplary embodiment. Therefore, elements including the same or corresponding functions and configurations as or to those in the first exemplary embodiment are denoted the same numerals, and the detailed descriptions thereof are omitted.

Figure 10B:
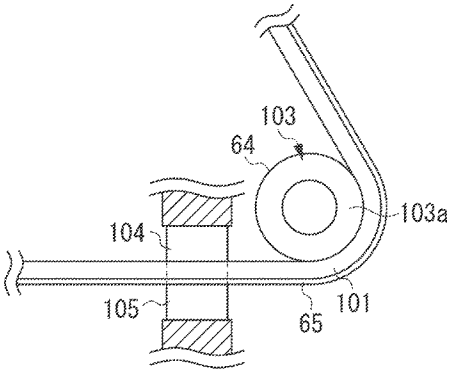
FIGS. 10A and 10B are a cross sectional view and a side view schematically illustrating yet another example of a support member for stabilizing belt shift regulation.
Figure 10A:
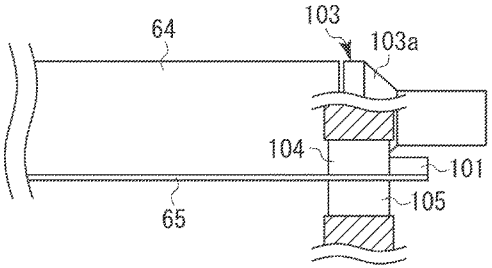

FIGS. 10A and 10B illustrate a configuration of the present exemplary embodiment. As illustrated in FIGS. 10A and 10B, in the present exemplary embodiment, the back surface side support member 104 and the front surface side support member 105 are disposed adjacent to the side of the regulation rib 101 in the width direction of the secondary transfer belt 65, not directly on the regulation rib 101. Particularly, in the present exemplary embodiment, the back surface side support member 104 and the front surface side support member 105 are disposed on the center side of the secondary transfer belt 65 in the width direction with respect to the regulation rib 101.

The back surface side support member 104 and the front surface side support member 105 are only required to be capable of regulating the attitude of the regulation rib 101 when the regulation rib 101 enters the regulation operation portion. Therefore, the back surface side support member 104 and the front surface side support member 105 can be disposed at a position far from the regulation rib 101 within the range in which the regulation force by the back surface side support member 104 and the front surface side support member 105 can keep the attitude of the regulation rib 101.

In this way, according to the present exemplary embodiment, a similar effect to that of the first exemplary embodiment can be achieved, and in addition thereto, the freedom of arrangement of the back surface side support member 104 and the front surface side support member 105 can be enhanced.

Other Embodiment

The exemplary embodiments of the present invention have been described above. However, the present invention is not limited thereto.

For example, in the above-described exemplary embodiments, the belt shift regulation means is configured in such a manner that similar elements are provided on both end portions of the secondary transfer belt in the width direction. However, it is not limited thereto. The regulation receiving member such as a regulation rib, and, the regulation portion such as a regulation roller are only required to be provided on at least one end portion of the belt in the width direction. Therefore, corresponding thereto, the back surface side support portion and the front surface side support portion are only required to be provided on at least one end portion of the belt in the width direction.

Figure 11:
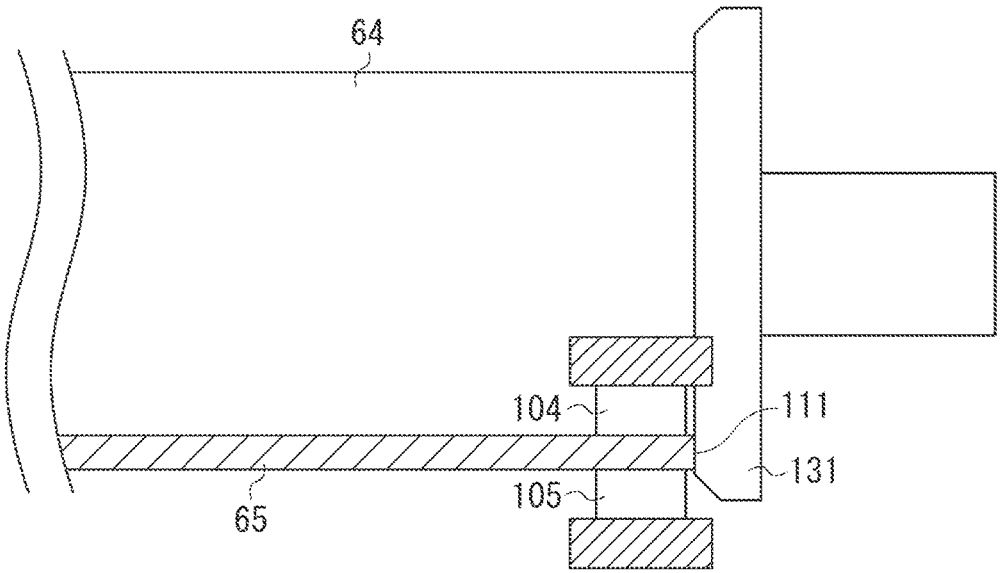
FIG. 11 is a cross sectional view schematically illustrating another embodiment according to the present invention.
Figure 12:
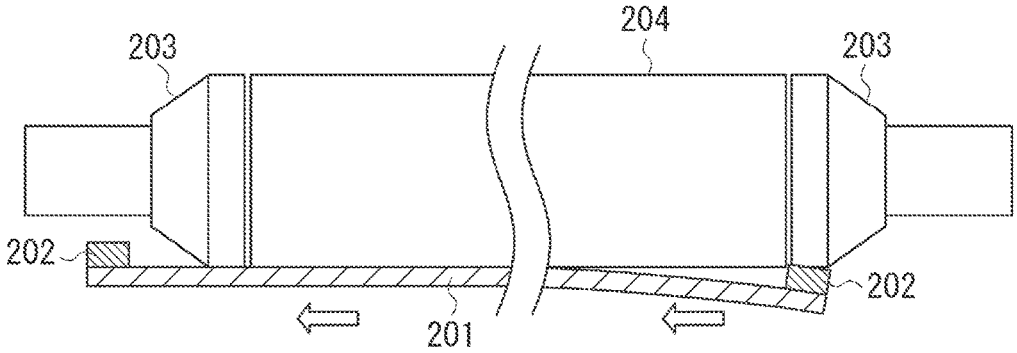
FIG. 12 is a cross sectional view schematically illustrating a belt ride-on state.

In addition, in the above-described exemplary embodiments, the regulation receiving member is a regulation rib, and the regulation portion is a regulation roller. However, they are not limited thereto. For example, as illustrated in FIG. 11, the belt shift can be regulated by bringing an end portion 111 of the secondary transfer belt 65 in the width direction (regulation receiving member) to an abutting member 131 provided on the end portion of the support roller 64 as a regulation portion. In this case also, similarly as illustrated in the above-described exemplary embodiments, the attitude of the end portion 111 of the belt (regulation receiving member) when entering the regulation operation portion can be regulated by the back surface side support member 104 and the front surface side support member 105.

The present invention can be applied to a belt conveyance apparatus including an intermediate transfer belt (intermediate transfer member), a recording medium conveyance belt (recording medium bearing member), a transfer belt (transfer member), a photosensitive member belt (image bearing member), as long as the endless belt is used. Further, as long as an image forming apparatus employing the belt conveyance apparatus including the belt shift regulation means, the present invention can be applied to any image forming apparatus of a tandem type/one drum type, an intermediate transfer type/recording medium conveyance type. Further, if a plurality of the image forming units are provided, the number of the image forming units is not limited to those of above-described exemplary embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-078794, filed Apr. 7, 2014, which is hereby incorporated by reference herein in its entirety.

What is claimed is:

1. A belt conveyance apparatus, comprising:

an endless belt;

a regulation rib provided on an inner circumferential surface side of the endless belt along a circumferential direction in an end portion of the endless belt with respect to a widthwise direction of the endless belt;

a plurality of rollers configured to support the endless belt, the plurality of rollers including a regulation roller having a regulation portion provided on an end portion of the regulation roller, the regulation portion regulating a position of the endless belt in the widthwise direction by the regulation rib being brought into contact with the regulation portion;

a frame configured to support the plurality of rollers; and a contact member, including a first contact portion and a second contact portion, disposed in the frame, and, when viewed from a rotation axis direction of the regulation roller, each of positions of downstream side end portions of the first contanct portion and the second contact portion being disposed near an upstream side of an upstream end portion of a contact portion in which the regulation rib contacts the regulation portion, in a conveyance direction of the endless belt, the first contact portion and the second contact portion facing each other across the endless belt at least at a region corresponding to the regulation rib, the first contact portion contacting at least the regulation rib, the second contact portion contacting an outer circumferential surface side of the endless belt at least at the region corresponding to the regulation rib.

2. The belt conveyance apparatus according to claim 1, wherein the contact member is disposed so as not to overlap a central area of the endless belt with respect to the widthwise direction.

3. The belt conveyance apparatus according to claim 1, wherein the contact member is non-rotatably and fixedly disposed.

4. The belt conveyance apparatus according to claim 1, wherein the contact member includes a felt.

5. The belt conveyance apparatus according to claim 1, further comprising:

an image bearing member configured to bear a toner image;

an intermediate transfer member onto which the toner image borne by the image bearing member is transferred;

a transferred portion at which the toner image transferred onto the intermediate transfer member is transferred onto a recording material; and a secondary transfer belt configured to convey a recording material to the transfer portion and convey the recording material onto which the toner image has been transferred, wherein the endless belt is the secondary transfer belt.

6. The belt conveyance apparatus according to claim 1, wherein the regulation portion includes a taper having a diameter that becomes smaller as going up toward an end portion in an axis direction of the regulation roller.

7. The belt conveyance apparatus according to claim 1, wherein the contact member comprises a fur brush.

8. The belt conveyance apparatus according to claim 1, wherein the contact member comprises at least a roller.

9. A belt conveyance apparatus, comprising:

an endless belt;

a regulation rib provided on an inner circumferential surface side of the endless belt along a circumferential direction in an end portion of the endless belt with respect to a widthwise direction of the endless belt;

a plurality of rollers configured to support the endless belt, the plurality of rollers including a regulation roller and an upstream roller, the regulation roller having a regulation portion provided on an end portion of the regulation roller, the regulation portion regulating a position of the endless belt in the widthwise direction by the regulation rib being brought into contact with the regulation portion, the upstream roller being disposed on an upstream side adjacent to the regulation roller with respect to a conveyance direction of the endless belt;

a frame configured to support the plurality of rollers; and a contact member, including a first contact portion and a second contact portion, disposed in the frame, and, the first contact portion and the second contact portion each being disposed in such a manner that, when viewed from a rotation axis of the regulation roller, a length from a position of a downstream side end portion of the first contact portion in a conveyance direction of the endless belt to a first position along with a tension surface of the endless belt is shorter than a length from the position of the downstream side end portion of the first contact portion in the conveyance direction of the endless belt to a second position, and a length from a position of a downstream side end portion of the second contact portion in the conveyance direction of the endless belt to the first position along with the tension surface of the endless belt is shorter than a length from the position of the downstream side end portion of the second contact portion in the conveyance direction of the endless belt to the second position, the first position being positioned on an upstream end portion of a contact portion in which the regulation roller contacts the endless belt, the second position being positioned on a downstream end portion of a contact portion in which the upstream roller contacts the endless belt, the tension surface being a surface, of the endless belt, which is tensioned between the regulation roller and the upstream roller, the first contact portion and the second contact portion facing each other across the endless belt at least at a region corresponding to the regulation rib, the first contact portion contacting at least the regulation rib, and the second contact portion contacting an outer circumferential surface side of the endless belt at least at the region corresponding to the regulation rib.

10. The belt conveyance apparatus according to claim 9, wherein the contact member is non-rotatably and fixedly disposed.

11. The belt conveyance apparatus according to claim 9, wherein the contact member includes a felt.

12. The belt conveyance apparatus according to claim 9, further comprising:

an image bearing member configured to bear a toner image;

an intermediate transfer member onto which the toner image borne by the image bearing member is transferred;

a transferred portion at which the toner image transferred onto the intermediate transfer member is transferred onto a recording material; and a secondary transfer belt configured to convey a recording material to the transfer portion and convey the recording material onto which the toner image has been transferred, wherein the endless belt is the secondary transfer belt.

13. The belt conveyance apparatus according to claim 9, wherein the regulation portion includes a taper having a diameter that becomes smaller as going up toward an end portion in an axis direction of the regulation roller.

14. The belt conveyance apparatus according to claim 9, wherein the contact member comprises a fur brush.

15. The belt conveyance apparatus according to claim 9, wherein the contact member comprises at least a roller.

* * * * *